US006880493B2

(12) United States Patent
Clifford

(10) Patent No.: US 6,880,493 B2
(45) Date of Patent: Apr. 19, 2005

(54) GAS WATER HEATER AND METHOD OF OPERATION

(76) Inventor: Todd W. Clifford, 4636 Sarah Dr., Mason, OH (US) 45040

( * ) Notice: Subject to any disclaimer, the term of this patent is extended or adjusted under 35 U.S.C. 154(b) by 0 days.

(21) Appl. No.: 10/139,565

(22) Filed: May 6, 2002

(65) Prior Publication Data

US 2002/0132202 A1 Sep. 19, 2002

Related U.S. Application Data

(63) Continuation-in-part of application No. 09/840,587, filed on Apr. 23, 2001, now Pat. No. 6,382,961, which is a continuation of application No. 09/594,544, filed on Jun. 14, 2000, now Pat. No. 6,220,854, which is a division of application No. 09/109,797, filed on Jul. 2, 1998, now Pat. No. 6,116,230, which is a continuation-in-part of application No. 08/591,398, filed on Jan. 25, 1996, now Pat. No. 5,813,394, which is a continuation-in-part of application No. 08/283,992, filed on Aug. 1, 1994, now Pat. No. 5,617,840, which is a continuation-in-part of application No. 07/856,347, filed on Mar. 23, 1992, now Pat. No. 5,333,596.

(51) Int. Cl.[7] ..... F22B 5/00
(52) U.S. Cl. ..... 122/14.22; 122/14.1; 122/14.2; 236/20 R
(58) Field of Search ..... 122/13.01, 14.1, 122/14.2, 14.22, 17.1, 17.2; 236/20 R, 1 A

(56) References Cited

U.S. PATENT DOCUMENTS

| | | | | |
|---|---|---|---|---|
| 3,289,801 A | | 12/1966 | Jerkins | |
| 3,292,821 A | | 12/1966 | Cowley | |
| 3,300,092 A | | 1/1967 | Williams | |
| 3,469,590 A | | 9/1969 | Barker | |
| 3,630,189 A | | 12/1971 | Hodges et al. | |
| 4,288,209 A | | 9/1981 | Yoshinaga | |
| 4,382,773 A | | 5/1983 | Sobole | |
| 4,805,587 A | | 2/1989 | Schweitzer | |
| 4,834,284 A | * | 5/1989 | Vandermeyden | 236/20 R |
| 5,003,960 A | | 4/1991 | Hanagan | |
| 5,033,449 A | | 7/1991 | Hanagan | |
| 5,044,520 A | | 9/1991 | Moisan | |
| 5,052,174 A | | 10/1991 | Bak | |
| 5,163,358 A | | 11/1992 | Hanagan et al. | |
| 5,169,303 A | | 12/1992 | Paluck | |
| 5,333,596 A | | 8/1994 | Clifford | |
| 5,388,984 A | | 2/1995 | Meslif | |
| 5,503,550 A | | 4/1996 | DePalma | |

(Continued)

FOREIGN PATENT DOCUMENTS

| | | | |
|---|---|---|---|
| EP | 0405014 | * | 1/1991 |
| JP | 9-252944 | * | 9/1997 |

OTHER PUBLICATIONS

Randy Meyer, *A.O. Smith Newsletter*, May, 1998.
A.O. Smith, *Parts List*, Jun., 1996.
A.O. Smith, *Manual for CYCLONE XHE Gas–Fired Water Heater*, pp. 1, 5, 16; date unknown.

*Primary Examiner*—Jiping Lu
(74) *Attorney, Agent, or Firm*—Wood, Herron & Evans, L.L.P.

(57) ABSTRACT

A gas water heater with a tank for holding water including a gas valve mounted below the tank and in fluid communication with a supply of gas. A gas burner is fluidly connected to the gas valve. A first temperature sensor is mounted adjacent a lower portion of the tank and detects a temperature of the water in the lower portion of the tank, and a second temperature sensor is mounted adjacent an upper portion of the tank and detects a temperature of water in the upper portion of the tank. A control has inputs connected to the first and second temperature sensors and outputs connected to the gas valve. The control operates the gas valve in response to reading signals from the first and second temperature sensors such that water in the top and bottom portions of the tank stays within a desired temperature range.

15 Claims, 10 Drawing Sheets

U.S. PATENT DOCUMENTS 5,544,856 A 8/1996 King et al.
5,590,642 A 1/1997 Borgeson et al.
5,594,616 A 1/1997 Brecht et al.
5,617,840 A 4/1997 Clifford
5,813,394 A 9/1998 Clifford
5,931,655 A 8/1999 Maher, Jr.
6,059,195 A * 5/2000 Adams et al. ..... 236/20 R
6,126,435 A 10/2000 Fredin-Garcia et al.
6,220,854 B1 4/2001 Clifford et al.
6,350,967 B1 2/2002 Scott
6,465,764 B1 * 10/2002 Shahin ..... 219/486

* cited by examiner

GAS WATER HEATER AND METHOD OF OPERATION

This application is a Continuation-in-Part of Ser. No. 09/840,587, filed on Apr. 23, 2001, Now U.S. Pat. No. 6,382,961, which is a Continuation of Ser. No. 09/594,544, filed on Jun. 14, 2000, now U.S. Pat. No. 6,220,854, which is a Division of Ser. No. 09/109,797, filed on Jul. 2, 1998, now U.S. Pat. No. 6,116,230, which is a Continuation-In-Part of Ser. No. 08/591,398, filed on Jan. 25, 1996, now U.S. Pat. No. 5,813,394, which is a Continuation-In-Part of Ser. No. 08/283,992, filed on Aug. 1, 1994, now U.S. Pat. No. 5,617,840, which is a Continuation-In-Part of Ser. No. 07/856,347, filed on Mar. 23, 1992, now U.S. Pat. No. 5,333,596.

FIELD OF THE INVENTION

The present invention relates generally to systems for igniting fuel and, more particularly, to a control system to improve the energy efficiency for a gas water heater.

BACKGROUND OF THE INVENTION

Gas water heaters have not extensively used electronic controls because of associated problems with electronic ignition systems and availability of an electrical outlet in close proximity to the water heater. There are two common types of electronic ignition: hot surface and direct spark ignition. Hot surface igniters are expensive, easily broken and require a considerable amount of electrical energy to operate. In comparison, spark igniters are inexpensive, durable and use little energy, however, the transient electrical pulses or voltage spikes from known spark ignition systems may undesirably interfere with electronic circuits. Due to these shortcomings, many gas water heaters use a non-electronic standing pilot ignition system.

As the Department of Energy (DOE) increases energy efficiency (EF) ratings for water heaters, manufacturers will need to look beyond foam insulation techniques to meet the new increased EF standards. Incorporating electronic controls and ignition systems can raise the energy efficiency ratings by eliminating the standing pilot and reducing the negative effects of stacking on energy efficiency. Stacking occurs when frequent small draws of water create different temperatures throughout the tank resulting in increased peak temperatures at the top of the tank.

Unlike electric water heaters, gas water heaters only have one source of heat and one temperature sensor. The source of heat is a burner typically located underneath the tank. A temperature sensing device near the bottom of the tank controls when the burner is turned on or "cuts-in". A typical gas water heater has a cold water inlet with a dip tube. As hot water is drawn from the tank, cold water passes through the dip tube and enters near the bottom of the tank and temperature sensor. As the cold water mixes with the water at the bottom of the tank, the temperature sensing device will initiate a cut-in. Frequent short draws will initiate multiple cut-ins causing the water at the top of the tank to become much hotter (stacking) than the set point temperature of the temperature sensing device at the bottom of the tank. Thus, there is a need to improve the performance of current water heaters to prevent stacking and thereby improve the Energy Efficiency (EF) rating.

Another shortcoming of current gas hot water heaters equipped with single temperature sensor control systems is a symptom referred to by some water heater manufacturers as "morning sickness". Morning sickness refers to a condition in which there has been an extended period of time in which no hot water has been drawn from the tank. The hot water at the top of the tank mixes with the colder water at the bottom of the tank until it reaches a consistent temperature throughout the tank. To prevent stacking, on single temperature sensor control systems, the control will not turn on the burner until the water temperature at the temperature sensor located near the bottom of the tank is 30° F. below the set point temperature. If the water heater is set at 120° F., the control will not turn on the burner until the temperature sensor reaches 90° F. If the water heater has been sitting without a draw for an extended period of time, the water temperature is as low as 95° F. throughout the whole tank when there is a need for hot water resulting in no hot water available or a considerably diminished capacity of hot water available when needed. In light of this shortcoming, a need exists to improve the performance of a water heater to assure that there is hot water available when needed.

Yet another obstacle in using an intelligent electronic control in gas water heaters is the availability of electricity in close proximity to the water heater. Most gas waters heaters sold are replacement units that are placed in homes where there is no electrical outlet nearby. Therefore an additional need exists for the electronic control to operate in a "cordless" mode for extended periods of time.

Fuel-connected appliances may comprise a spark ignition system to ignite fuel at a burner. In known single electrode spark ignition systems for appliances, fuel emanates from a burner that is typically grounded to the chassis of the appliance. The chassis, however, may not be properly grounded. For example, the chassis of an appliance is resting on nonconductive plastic or rubber wheels, or the chassis is resting on a nonconductive surface such as wood. In order to ignite the fuel, a voltage potential difference is generated between an electrode and the burner. The voltage potential difference is in the range of 12,000 to 20,000 volts. Consequently, a 12,000 to 20,000 volt ignition spark is generated between the electrode and the burner. An ignition spark of this magnitude may cause transient electrical pulses or voltage spikes to undesirably interfere with the performance of electronic circuitry of the appliance. For instance, the transient electrical pulses or voltage spikes may interfere with the performance of a microprocessor-based or microcontroller-based control circuit of an appliance. The transient electrical pulses or voltage spikes may also reset a microprocessor power supply that typically operates at 5 volts. In addition, the transient electrical pulses or voltage spikes may damage components of electric circuitry, may cause a microprocessor or microcontroller to incorrectly process information, and/or may cause electronic circuitry to lockup or crash.

Due to the shortcomings of known single electrode spark ignition systems when used in conjunction with electronic circuitry, manufacturers of appliances have instead used dual electrode spark ignition systems, hot surface igniters to ignite fuel, and single electrode spark ignition systems with a discrete spark module control isolated from the main microprocessor-based electronic control system. U.S. Pat. Nos. 5,003,960 and 5,033,449 disclose embodiments of a dual electrode spark ignition system. In a dual electrode spark ignition system, a spark is caused to jump from one electrode to another electrode, rather than from one electrode to chassis ground.

In order to prevent transient electrical pulses or voltage spikes from interfering with electronic circuitry, both electrodes of a dual electrode spark ignition system are heavily isolated from chassis ground and the electronic circuitry. For example, U.S. Pat. Nos. 5,003,960 and 5,033,449 utilize a ceramic insulating material to isolate the electrodes. Nevertheless, water or other conductive materials may gather on the insulating materials and short the electrodes to chassis ground and/or the electronic circuit. In addition, cracks may develop in the insulating material. As a result, water or other conductive materials may enter the cracks and short the electrodes to chassis ground and/or the electronic circuitry.

Also, in order to prevent transient electrical pulses or voltage spikes from interfering with electronic circuitry, appliance controls like those produced by Invensys of Carol Stream, Ill. and supplied to companies like Whirlpool of Benton Harbor, Mich. utilize a separate spark module control board isolated from the microprocessor control board. Besides being more costly and adding an additional component part to the appliance, the risk remains that transient electrical pulses or voltage spikes may reach the control through the cable assembly or other means.

On the other hand, a hot surface igniter may not interfere with the functions of a microprocessor or other electronic circuitry. For example, many appliance controls have significant shortcomings for use in water heaters. First, the igniter elements is made of silicon carbide or other similar fragile materials that may easily break or be damaged during shipment. Second, hot surface igniters may have a high field failure rate due to the igniter's elements burning out. Third, hot surface igniters may cost approximately seven times more than a single electrode spark igniter. Fourth, condensation shortens the life span of a hot surface igniter. Finally, hot surface igniters require a significant amount of electrical current to operate.

In light of the shortcomings of the above-mentioned systems, a need exists for a reliable and less expensive single electrode spark ignition system that does not damage or interfere with the performance of electronic circuitry and consumes very little power.

SUMMARY OF THE INVENTION

The present invention provides gas water heater that is capable of maintaining a substantially constant temperature throughout the tank. The gas water heater of the present invention does not permit temperature stacking, that is, undesirably hot temperatures at an outlet of the water heater. In addition, the water heater of the present invention does not suffer from morning sickness, that is, undesirably cold temperatures at the outlet of the water heater. Therefore, the gas water heater of the present invention provides a substantially improved performance for the user and, in addition, operates with a significant improved efficiency.

According to the principles of the present invention and in accordance with the described embodiments, the invention provides a water heater with a tank for holding water. A gas valve is mounted below the tank and is in fluid communication with a supply of gas, and a gas burner is fluidly connected to the gas valve A first temperature sensor is mounted adjacent a lower portion of the tank and detects a temperature of the water in the lower portion of the tank, and a second temperature sensor is mounted adjacent an upper portion of the tank and detects a temperature of water in the upper portion of the tank. A control has inputs connected to the first and second temperature sensors and outputs connected to the gas valve. The control operates the gas valve in response to reading signals from the first and second temperature sensors such that water in the top and bottom portions of the tank stays within a desired temperature range.

In another embodiment of the invention, a method is provided for operating a gas fired water heater. A first temperature of the water is detected in an upper portion of a tank storing water in the water heater, and a second temperature of the water is detected in a lower portion of the tank. The application of heat is initiated and discontinued in response to the first and the second temperatures to maintain water in the upper and lower portions of the tank at a desired temperature.

These and other objects and advantages of the present invention will become more readily apparent during the following detailed description taken in conjunction with the drawings herein.

DETAILED DESCRIPTION OF THE INVENTION

The present invention is directed to methods and devices for substantially reducing the stacking effect within a storage type gas water heater with the aid of multiple temperature sensors.

For example, the present invention is used for, or in conjunction with, practically any apparatus that is adapted to provide heat by igniting natural gas, propane gas, or practically any other fuel that is ignited to provide heat. In particular, the apparatus is a storage type residential gas water heater. The apparatus may also be a commercial water heater, boiler, or any other type of water heating appliance.

The ignition device is practically any device that is adapted to ignite fuel. For instance, the ignition device is a single electrode spark ignition system or a dual electrode spark ignition system. The ignition device may also be a hot surface igniter or standing pilot. The ignition device of the described embodiment is a single electrode spark ignition system.

Figure 1:
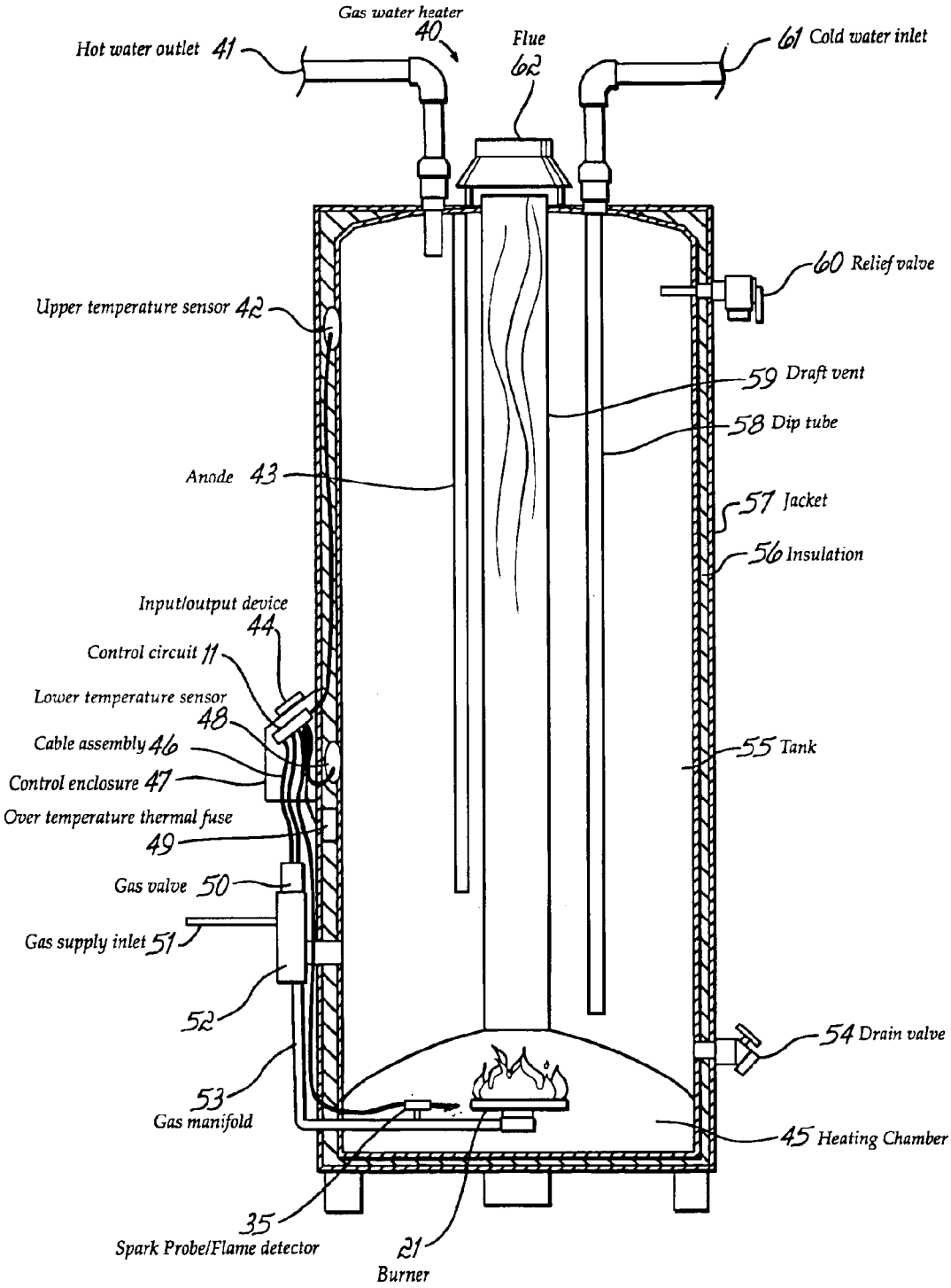
FIG. 1 is a partial cross-sectional view of a gas water heater with a multiple temperature sensor control system in accordance with the principles of the present invention.
Figure 6:
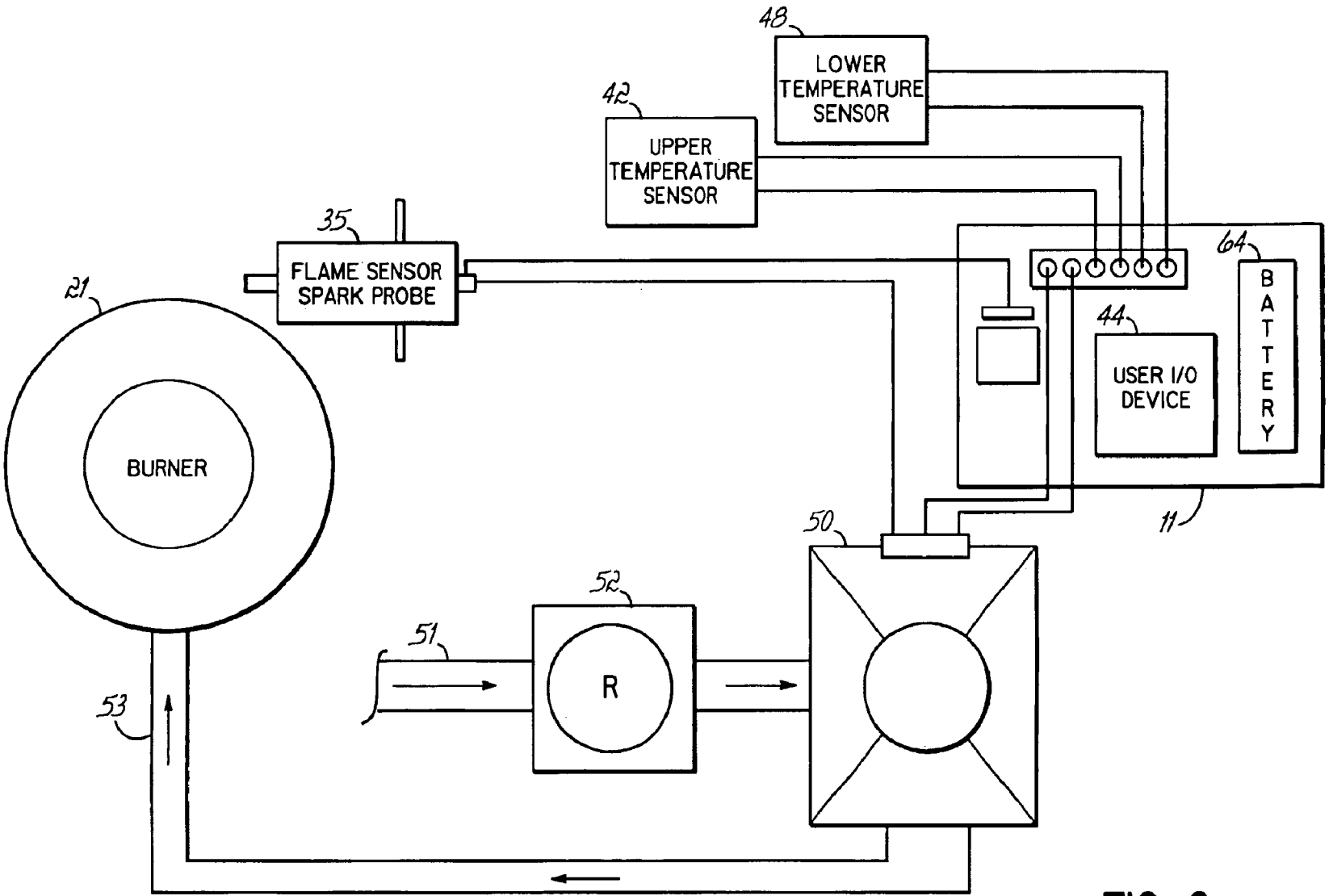
FIG. 6 is a schematic diagram of a battery operated control system in accordance with the principles of the present invention.

As illustrated in FIGS. 1 and 6, a gas water heater 40 has a cylindrical tank 55 wrapped in insulation 56 with an outer jacket 57. Located at the top of the tank 55 is a cold water inlet 61 with a dip tube 58 extending vertically into the tank 55 and a hot water outlet 41. The heating chamber 45 is located underneath the tank 55. The tank 55 is heated by burner 21 disposed there below to diffuse and radiate heat over a relatively large portion of the bottom of the tank 55 heating the water in the tank 55. The gas supply inlet 51 is connected to a gas valve 50, for example one or more solenoid-actuated valves. A conventional flow regulator 52 is interposed between the valve(s) 50 and the gas supply inlet 51. A gas manifold 53 is interposed between the gas valve 50 and the burner 21. Combustion gases are vented through the draft vent 59 and exit through the flue 40. A first lower temperature sensor 48 is mounted in contact with, and near a lower end of, the tank 55 in a known manner; and a second upper temperature sensor 42 is mounted in contact with, and near the top of, the tank 55.

The gas valve 50 is electrically connected through a cable assembly 46 to a control circuit 11 that controls the ignition, flow of gas, safety features, temperature control and visual display, as described in some detail below. A 120 VAC or 220 VAC power supply (not shown) is connected via conductor to the control circuit 11 in a known manner. A battery 64 may replace the 120 VAC or 220 VAC power supply. The battery 64 may be either a rechargeable or a non-rechargeable battery.

Figure 5:
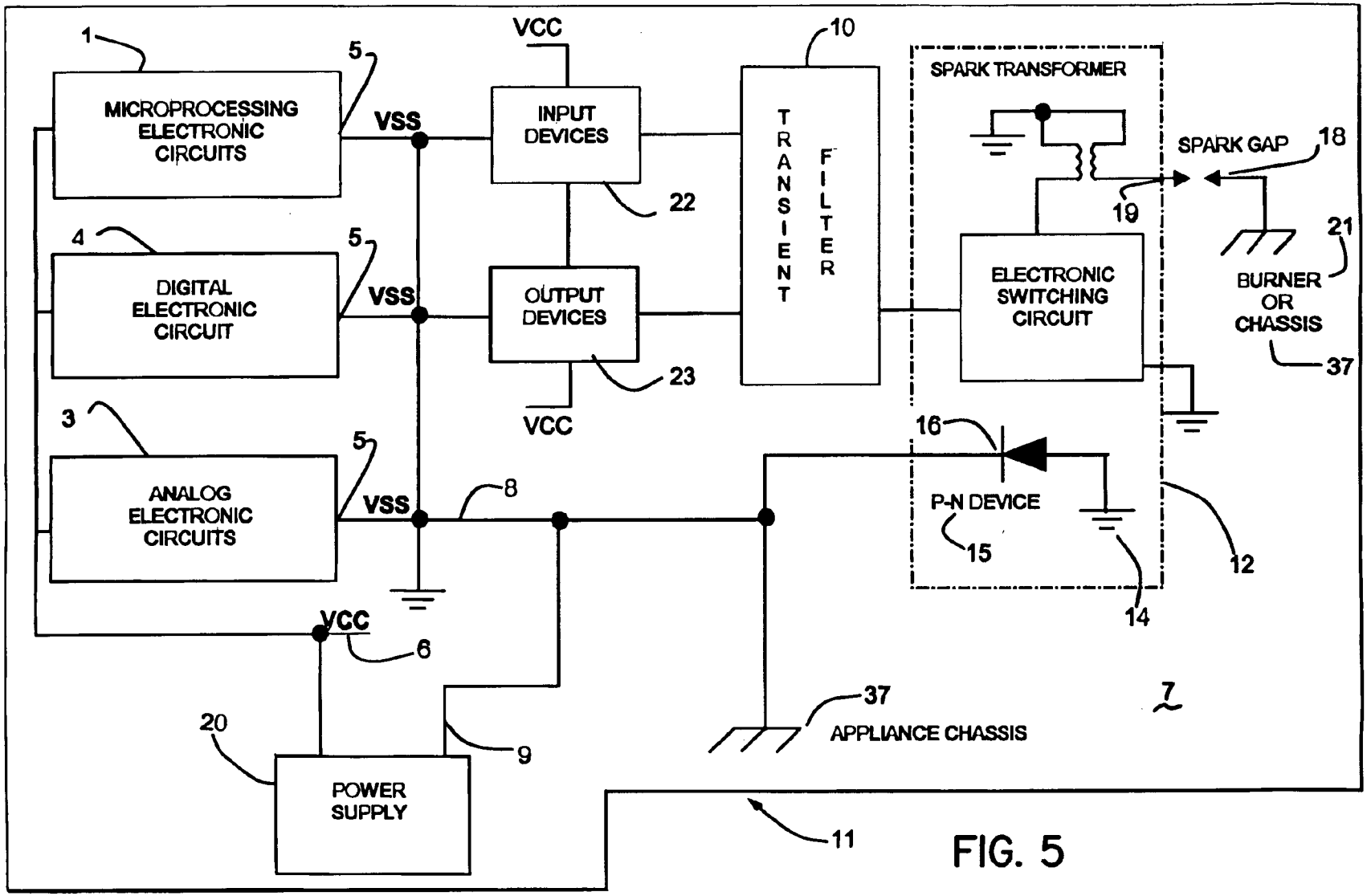
FIG. 5 is a schematic diagram of an embodiment of a single electrode spark ignition system in accordance with the principles of the present invention.

The control circuit 11 has a programmable microcontroller within the microprocessing electronic circuits 1 of FIG. 5. Such a microcontroller is capable of performing arithmetic and logic functions as required, and the microcontroller often includes an analog to digital converter that can be used to interface with the temperature sensors 42, 48. The control circuit 11 is electrically connected through a cable assembly 46 to an input/output device 44, the upper and lower temperature sensors 42, 48, an over temperature thermal fuse 49 in contact with the tank 55, the spark probe/flame sensor 35 and the power supply. The control circuit 11 is equipped with conventional switching mechanisms for controlling the flow of current from the power supply to the gas valve 50 in response to operating states determined by the control circuit 11.

The input/output device 44 is any conventional input/output device including, but not limited to, a touch keypad, a keyboard, a switch, a button, RS232 serial interface, or voice activated control. If desired, the input device is combined with any conventional output device, such as a visual display, an audible alarm or a flashing light.

Figure 2A:
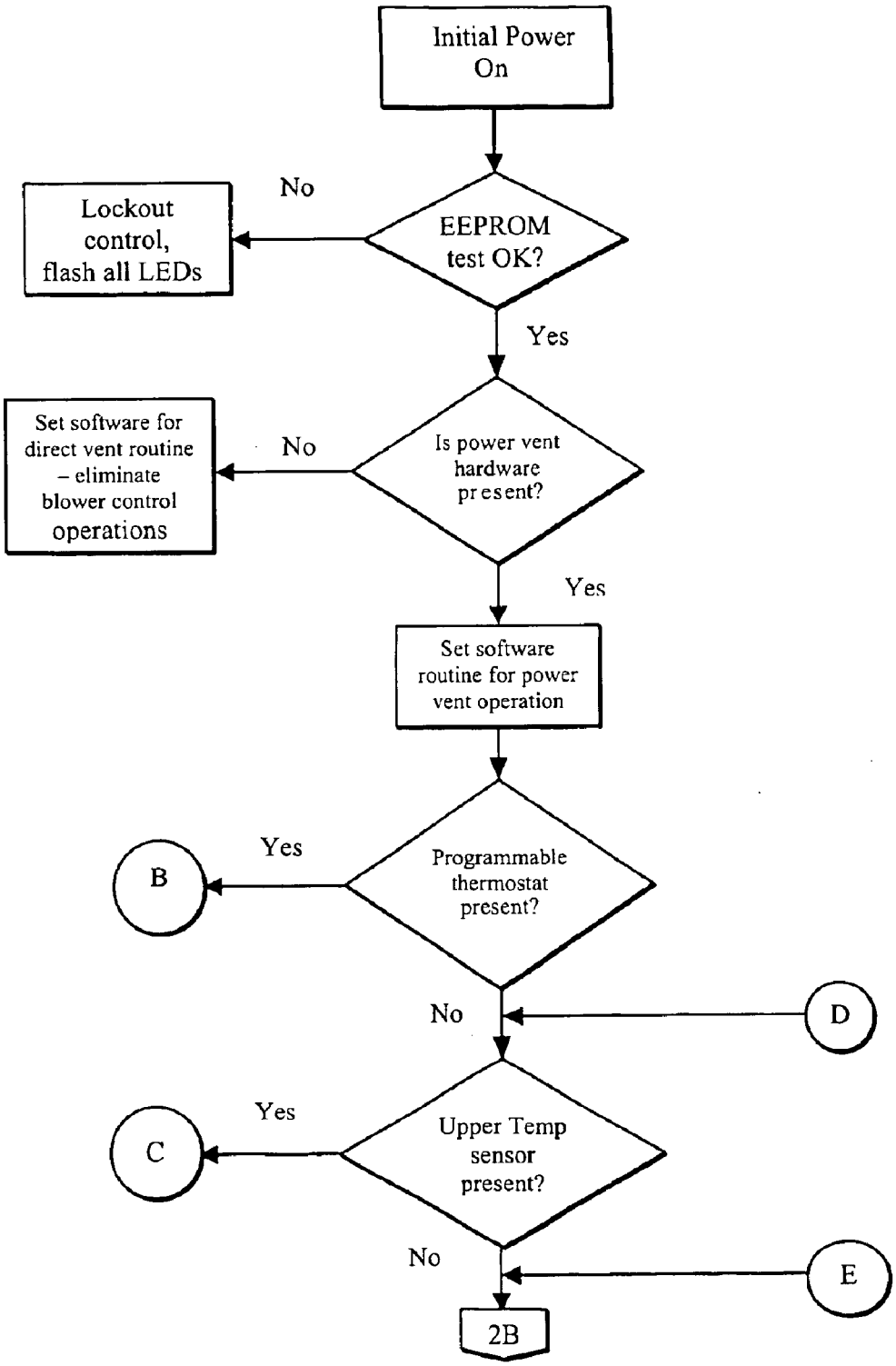
FIGS. 2A–2F are flowcharts illustrating the logic sequence of a described embodiment of a control program of the present invention.
Figure 2B:
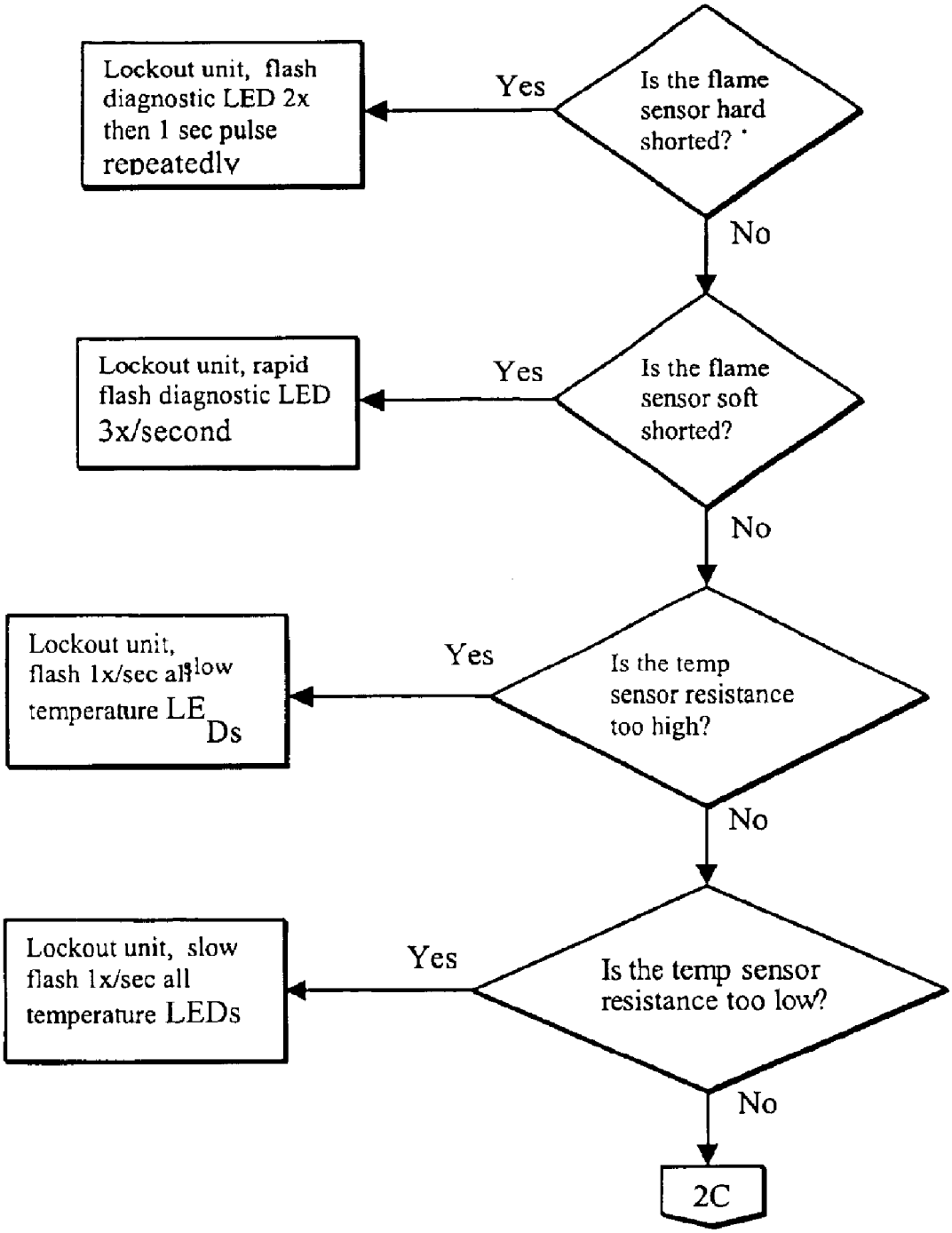

In this embodiment, the microprocessing electronic circuits 1 of the control circuit 11 execute a control program for the gas water heater 40 in the manner illustrated in the flowcharts of FIGS. 2A–2F. The user first presses an ON switch on the input/output device 44 to place the water heater 40 in operation. Referring to FIG. 2A, once power is supplied to the control circuit, it first performs an EEPROM test diagnostics on connected devices and a hardware check to see if additional optional devices, for example, a power vent blower, are connected to the control circuit 11. If a power vent blower is detected, the control circuit 11 then sets a software routine for power vent operation. Thereafter, the control circuit 11 tests for the presence of a programmable thermostat feature.

In this embodiment, the water temperature readings from both the upper and lower temperature sensors 42 and 48 are processed by programmed subroutines within the microprocessing electronic circuits 1 of the control circuit 11 in a manner that functions as a programmable thermostat. Programmable thermostat functions are commonly used in the operation of gas furnaces and can readily be applied to this application. Further, such functions include operating timers, a clock and simple arithmetic computations to define temperature ranges based on readings from each of the temperature sensors 42, 48. As will be appreciated, the programmable thermostat functions can be performed by a microcontroller separate from the microprocessing electronic circuits 1 of the control circuit 11.

Figure 2C:
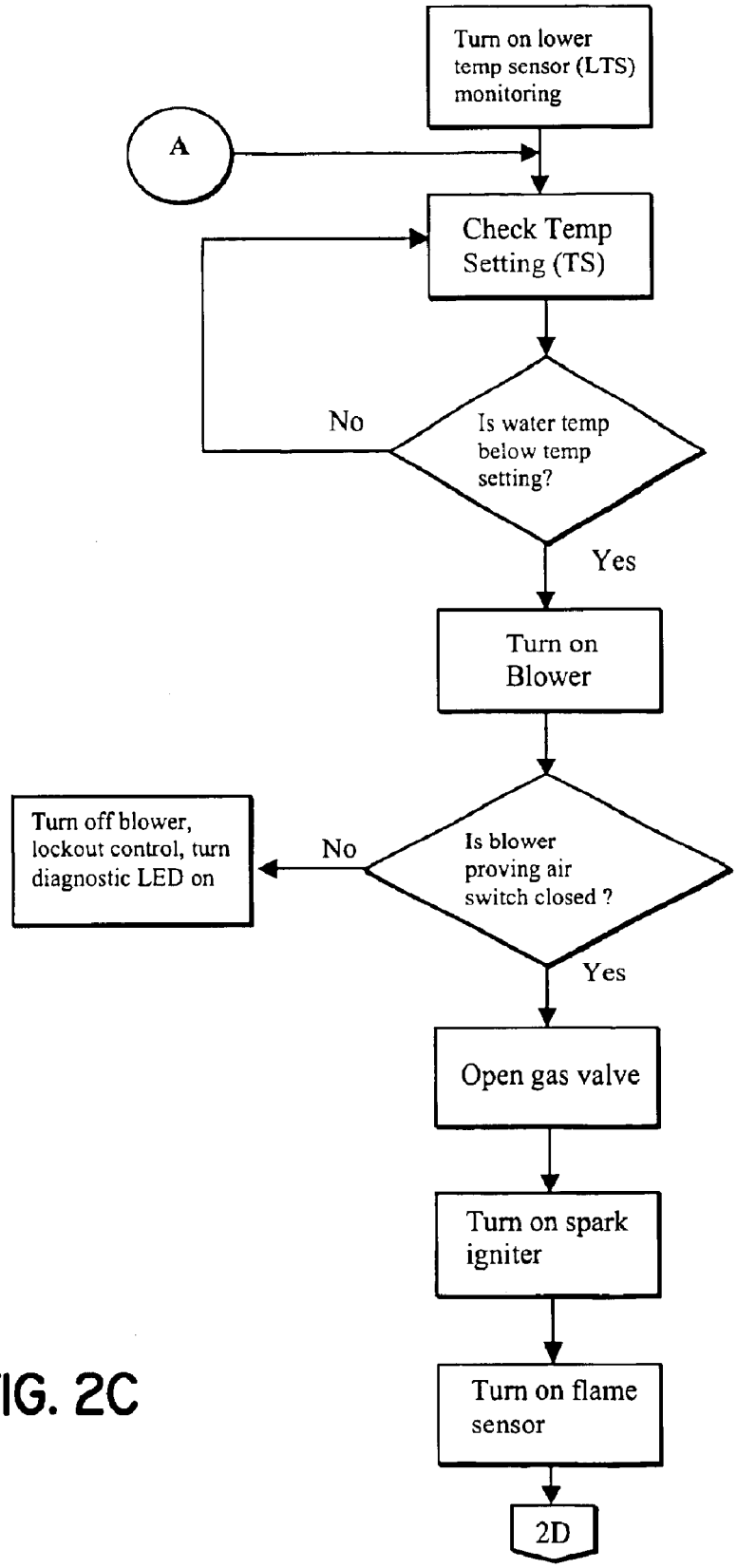
Figure 2D:
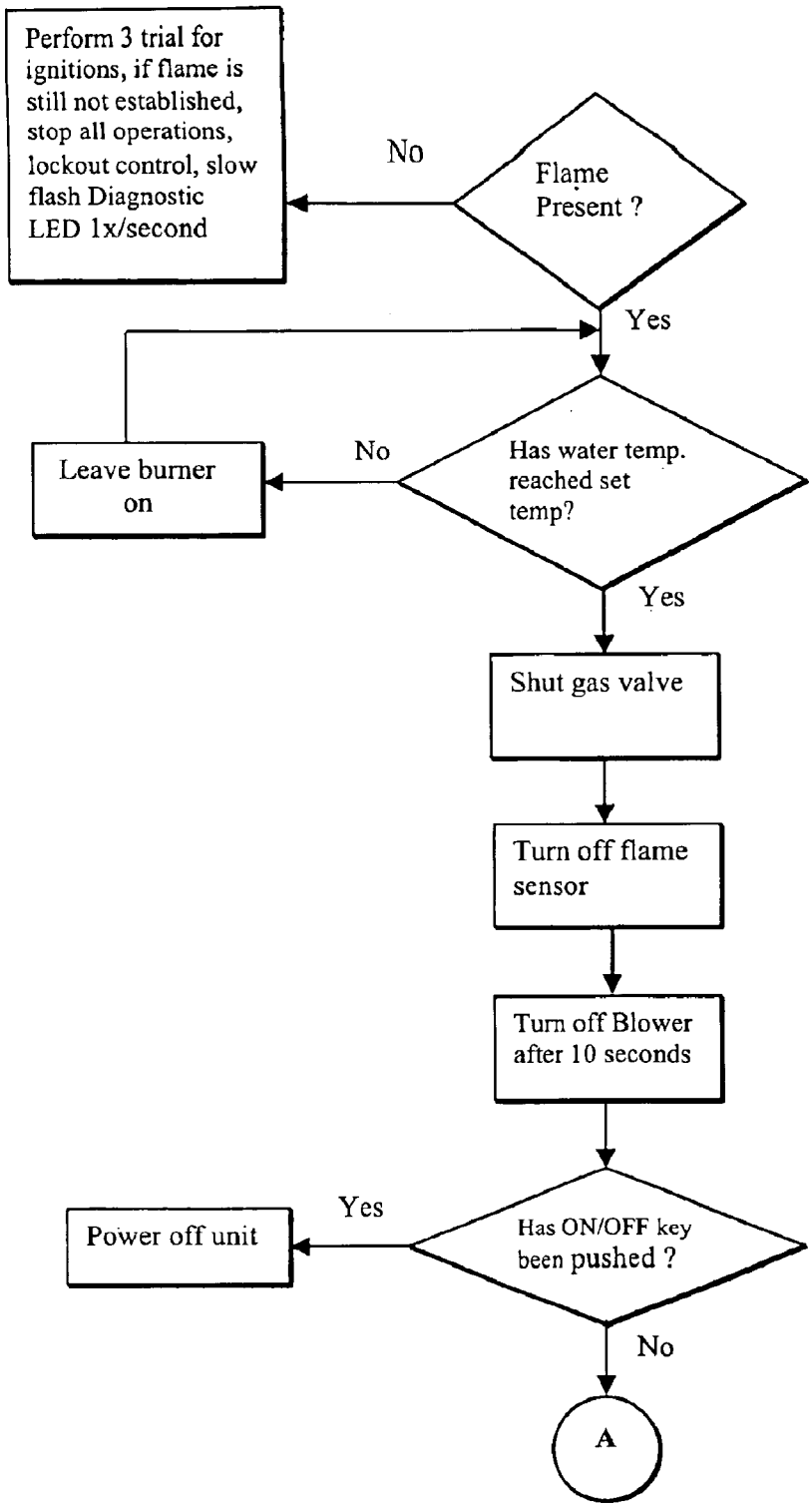
Figure 2E:
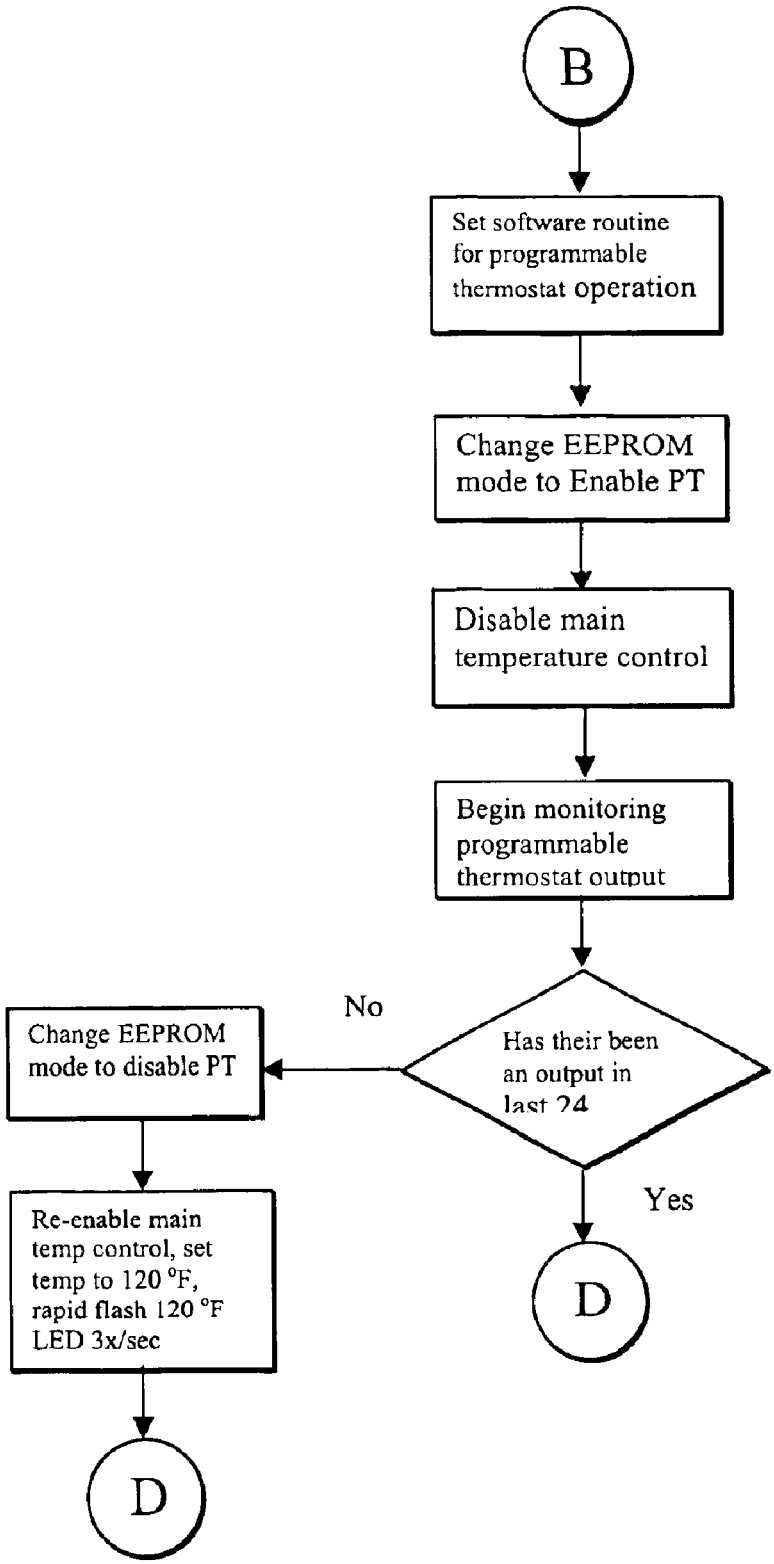
Figure 2F:
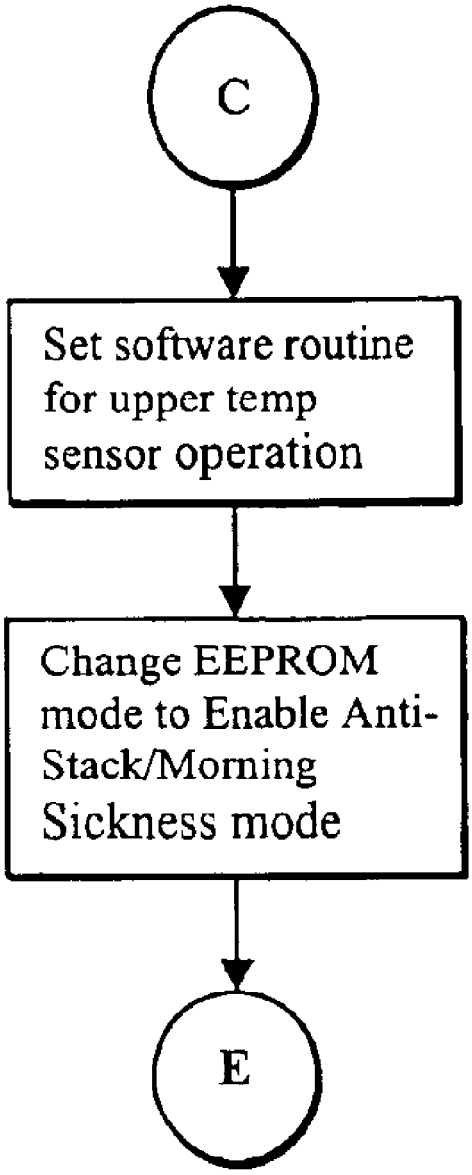

If, in FIG. 2A, a programmable thermostat feature is detected, referring to FIG. 2E, the control circuit 11 then activates a software routine for the programmable thermostat operation. In that process, the EEPROM mode is changed to enable the programmable thermostat. In addition, the main temperature control is disabled and the control circuit 11 then begins monitoring the output of the programmable thermostat. The control circuit 11 then checks whether the programmable thermostat is present and operating. If it is not receiving an output from the programmable thermostat feature, the control circuit 11 then disables the EEPROM mode and re-enables the main temperature control.

If the programmable thermostat feature is operating, referring back to FIG. 2A, the control circuit 11 then determines whether the upper temperature sensor is present. If the upper temperature sensor 42 is present, referring to FIG. 2F, the control circuit 11 then enables a software routine that provides signals from the upper temperature sensor to the programmable thermostat feature. Thereafter, the control circuit 11 resets the EEPROM mode to enable anti-stacking and anti-morning sickness operations. The process then returns to FIGS. 2A and 2B, where the control circuit 11 performs a series of tests to check whether the flame sensor 35 (FIG. 6) is shorted and whether the resistance of the temperature sensors 42, 48 is in acceptable range.

If all of the sensors are functioning properly, referring to FIG. 2C, the control circuit 11 then proceeds to read a desired water temperature setting ("TS") input by the user via the user I/O devices 44. If the user does not select a desired water temperature setting, the control circuit uses a default setting of 120° F. The control circuit 11 then determines whether the detected water temperature ("T") is close to the desired water temperature selected by the user. The control circuit first determines whether the water temperature measured by the lower temperature sensor 48 is too low by the following: Is T<TS−20° F.? For example, with a TS of 120° F., is the water temperature detected by the lower temperature sensor 48 below 100° F.? If so, the control circuit 11 proceeds to ignite the burner as will be described. If, however, the lower temperature sensor detects a temperature higher than 100° F., the control circuit 11 then determines whether the water temperature measured by the upper temperature sensor 42 is too low, for example, is T<TS−10° F.? Again, with a TS of 120° F., is the water temperature detected by the upper temperature sensor 42 below 110° F.?

If so, the control circuit 11 proceeds to ignite the burner by first turning on a blower and checking a change of state of an air switch that proves the blower is operating. Thereafter, the control circuit 11 signals the gas valve 50 to open, and gas flows to the burner 21. Shortly thereafter, the control circuit 11 activates the spark ignition circuit to create a spark at the spark probe 35 and ignite the gas. Referring to FIG. 2D, if a flame detector 35 senses a flame at the burner 21, a signal is sent to the control circuit 11 to turn off the spark ignition circuit. If no flame is detected, the control circuit 11 closes the gas valve 50, waits a purge period and reattempts ignition at the burner 21. After a number of attempts with no ignition at the burner 21, the control circuit 11 shuts down or locks out and displays an error code on the input/output device 44. As may be readily understood, the foregoing portion of the program prevents unignited gas from continuing to flow from the gas supply inlet 51 in the event the spark probe 35 fails to create a flame at the burner 21 within a selected period of time.

If a flame is present, the control circuit 11 then monitors the temperature of the water while the burner is on. The water temperature rises and when the control circuit 11 reads a temperature from the lower temperature sensor equal to the temperature setting, in the present example, 120° F., the control circuit 11 initiates a shutdown of the burner. However, as the water is heated, even though the water temperature as measured by the lower temperature sensor is below the temperature setting of 120° F., the control circuit 11 may still turn the burner off. For example, if the control circuit 11 determines that the water temperature as measured by the upper temperature sensor 42 is too high, for example, T>TS+10° F. or 130° F., the control circuit 11 turns off the burner. In turning off the burner, the control circuit 11 first initiates a closure of the gas valve and turns off the flame sensor. After a short delay, for example, about 10 seconds, the control circuit 11 shuts off the blower and thereafter, determines whether the user has disabled the water heater operation. If not, referring to FIG. 2C, the control circuit 11 then again checks the current temperature value input by the user and monitors the water temperature in the water heater in a manner as described earlier.

Thus, the use of two temperature sensors prevents temperature stacking. As small amounts of water are repeatedly drawn from the tank, the water temperature at the bottom of the tank will drop, however, the water temperature at the top of the tank will remain high. Further, as the burner cycles and heats the water in the tank, the control circuit 11 does not allow the water temperature at the top of the tank to exceed the temperature setting plus 10° F. In addition, morning sickness is also cured because the burner will be turned on any time that the water temperature as measured by the upper temperature sensor drops below the temperature setting minus 10° F.

It should also be noted that with known gas water heaters having a single temperature sensor, the dip tube the dip tube must be considerably shorter than a dip tube used with a multiple temperature sensor control system. Longer dip tubes are better because they have a positive effect on energy efficiency by distributing the incoming cold water closer to the bottom of the tank. Keeping the cold water close to the burner improves heat transfer from the burner and increases energy efficiency in heating the water. Also, longer dip tubes improve the first hour delivery rating or the capacity of hot water delivered by reducing the amount of mixing of the incoming cold water with the already heated water in the tank. However, with known gas water heaters, a longer dip tubes increases the stacking effect, which causes unacceptable elevated temperatures at the top of the tank.

DOE tests of the present invention conducted at AO Smith Water Products Company in Ashland City, Tenn. on a 75-gallon capacity water heater improved the DOE EF rating on the tested water heater from 0.53 to 0.61. This is a substantial improvement over a single temperature sensing device control system.

Figure 3:
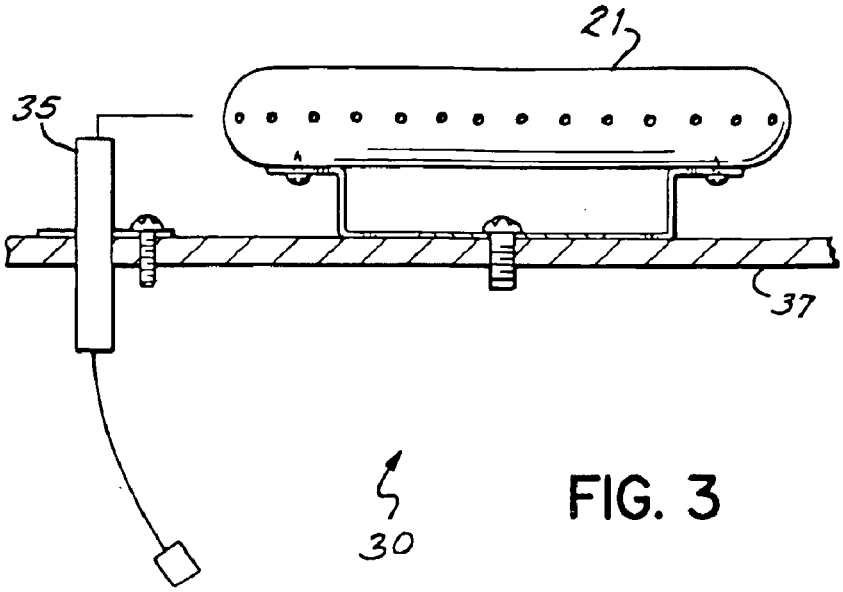
FIG. 3 is a partial cross-sectional view of a gas appliance in which a single electrode spark igniter sparks directly to a burner in accordance with the principles of the present invention.

Referring to FIGS. 3 and 5, a gas appliance 30 includes, in part, a single electrode 35 mounted adjacent a burner 21 that is grounded to the chassis 37. The electrode 35 is electrically connected to a high voltage output 19 of a control circuit 11. During an ignition event, the control circuit 11 develops a high potential between the single electrode 35 and the burner 21. The high potential causes an arc or spark to jump from the electrode 35 to the burner 21, thereby igniting fuel emanating from the burner 21.

Figure 4:
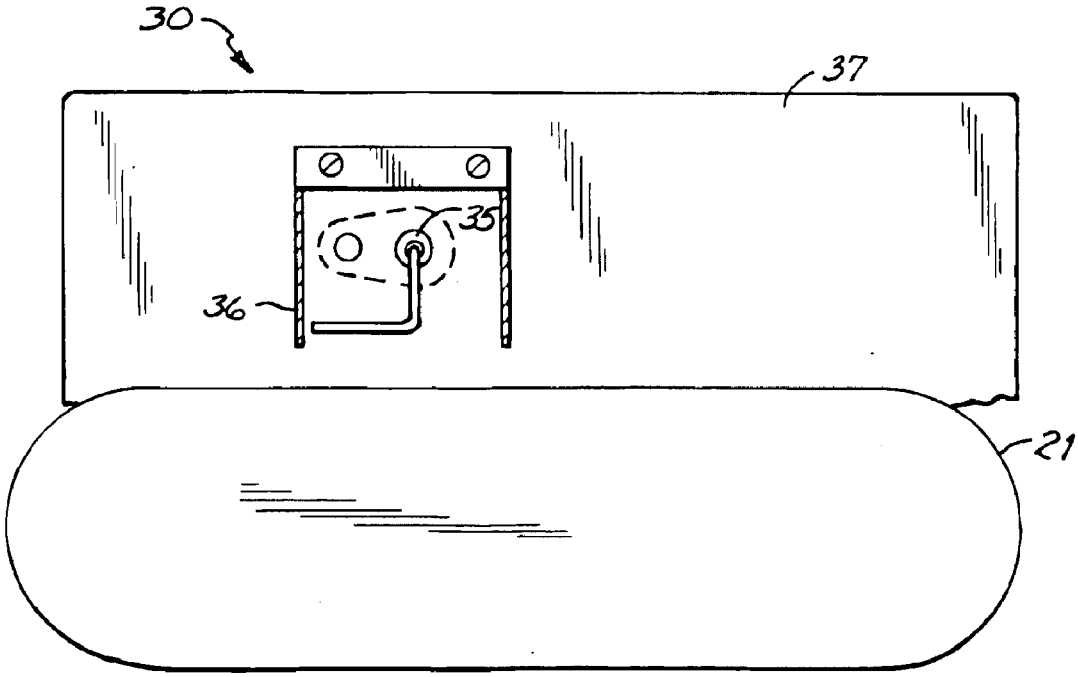
FIG. 4 is a partial top plan view of a gas appliance in which a single electrode spark igniter sparks directly to a metal plate adjacent to a burner in accordance with the principles of the present invention.

Referring to FIGS. 4 and 5, in an alternative embodiment, the gas appliance 30 has the burner 21 grounded to a metal plate 36 adjacent the burner 21. Again, the electrode 35 is electrically connected to a high voltage output 19 of a control circuit 11. During an ignition event, the control circuit 11 develops a high potential between the single electrode 35 and the metal plate 36. The high potential causes an arc or spark to jump from the electrode 35 to the metal plate 36, thereby igniting fuel emanating from the burner 21. In the above embodiments, the gas appliance 30 is a water heater 40.

A control circuit 11 shown in FIG. 5 creates the ignition event. The control circuit 11 is comprised, in part, of microprocessing circuits 1, analog electronic circuits 3, digital electronic circuits 4 and a power supply 20. The power supply 20 provides a VSS ground on an output 9, and that VSS ground is provided over a first ground plane 8 to VSS ground inputs of circuit components within the circuits 1, 3 and 4. It is known that the circuits 1, 3 and 4 are sensitive to electrical noise, for example, a voltage spike of only about 1 volt on the VSS ground terminal 9 can cause an operational fault in any of the circuits 1, 3 and 4. The power supply 20 provides a supply voltage, VCC, on an output 6, and that VCC supply voltage is provided to VCC inputs of the circuits 1, 3 and 4. Further, a voltage spike of about 600 millivolts above the power supply VCC output 6 also can cause an operational fault in any of the circuits 1, 3 and 4.

Therefore, for reliable operation of the circuits 1, 3 and 4, a transient electromagnetic pulse emanation standard ("TEMPEST") design is implemented that includes input and output filtering of the electronic circuits that are susceptible to voltage spikes as described above. Voltage spikes may interfere with normal operation of electronic circuitry and/or may destroy electronic components in electronic circuitry.

A TEMPEST design requires that a properly designed printed circuit board 7 use proper grounding design techniques. To prevent voltage spikes on the VSS ground, all of the components within the circuits 1, 3 and 4 have respective VSS ground pins 5 connected to the ground plane 8. Further, each of the VSS ground pins 5 in the circuits 1, 3 and 4 should be connected to the ground plane 8 at a single point. In addition, the VSS ground pins of the integrated circuits 1, 3, 4 should be connected to the VSS ground terminal 9 of the power supply 20 through the widest and shortest path on the ground plane 8.

At times, the inputs and outputs of the circuits 1, 3, and 4 are at a high impedance state and are filtered by a transient suppression filter 10. The filter 10 normally has a time constant of about 5–10 times longer than the rise and fall times of the voltage spikes. This time constant helps to insure the suppression of the voltage spikes.

The VSS ground of the control circuit 11 is separated from and not connected to a common ground 14 of the high voltage spark circuit 12. The common ground 14 of the spark circuit 12 is isolated from the common ground 8 of the control circuit 11 by a P-N junction device 15. The P-N junction device 15 is connected in a forward biased mode, that is, an N side 16 of the device is connected to the ground plane 8 of the control circuit 11. This raises the common ground 14 of the spark circuit 12 above the spark ignition common ground 8 and allows the single point on the ground plane 8 to remain intact. Therefore, all of the VSS grounds in the control circuit 11 can be connected to the chassis ground 37 at this single point.

The control circuit 11 also includes input devices 22 that may be any devices for providing an input command or state, for example, switches, a keypad, thermocouple, etc. The control circuit 11 also includes output devices 23 that may be any devices for providing an output command or state, for example, audio or visual displays, etc. The input and output devices 22, 23 also have grounds connected to the common ground plane 8.

In normal operation, a high voltage output 19 of the spark circuit 12 provides arcs or sparks across a gap directly to chassis ground 37, a burner 21 that is electrically connected to chassis ground 37, or a receptor 18 that is electrically connected to the chassis ground 37. The receptor 18 is a metal plate 36 (FIG. 4) that is electrically connected to chassis ground 37 near the burner 21. With the isolation provided by the P-N junction device 15, the high voltage sparks across the gap do not interrupt or destroy any components in the electronic circuits 1, 3 and 4.

While the present invention has been illustrated by a description of various embodiments and while these embodiments have been described in considerable detail, there is no intention to restrict or in any way limit the scope of the appended claims to such detail. Additional advantages and modifications within the spirit and scope of the invention will readily appear to those skilled in the art. For example, in the described embodiment, various temperatures are used as examples for controlling the operation of the burner. As will be appreciated, in alternative embodiments, other temperature ranges for the upper and lower portions of the storage tank may be used.

Further, the control circuit 11 includes microprocessor electronic circuits 1, analog electronic circuits 3 and digital electronic circuits 4. As will be appreciated, in some gas appliances, two or more temperature sensors may be used or one or more of the electronic circuits may not be used. For example, some control circuits may not have the microprocessing electronic circuits 1; others may not have the digital electronic circuits 4; and still others may not have the microprocessing electronic circuits 1 and the digital electronic circuits 4.

Therefore, the invention in its broadest aspects is not limited to the specific details shown and described. Consequently, departures may be made from the details described herein without departing from the spirit and scope of the claims that follow.

What is claimed is:

1. A method for operating a gas fired residential water heater having a water storage tank with a hot water outlet and a cold water inlet dip tube therein, the method comprising:

detecting a first temperature of water in an upper portion of the tank;

detecting a second temperature of water in a lower portion of the tank;

applying heat to the tank to minimize stacking of water temperature in the tank in response to first, the first temperature at the water in the upper portion of the tank being below a set point temperature plus a fixed, upper temperature differential, and second, the second temperature of the water in the lower portion of the tank being less than a set point temperature minus a fixed, lower temperature differential;

applying heat to the tank in response to first, the second temperature of the water in the lower portion of the tank being above the set point temperature minus the fixed, lower temperature differential, and second, the first temperature of the water in the upper portion of the tank being less than the set point temperature minus a fixed, upper temperature differential, to maintain water in the upper portion and lower portion of the tank at a desired temperature.

2. The method of claim 1 further comprising:

removing the application of heat from the tank in response to the second temperature of the water in the lower portion of the tank being substantially equal to the set point temperature; and removing the application of heat from the tank in response to the first temperature of the water in the upper portion of the tank being above the set point temperature plus the fixed, upper temperature differential.

3. The method of claim 2 further comprising automatically controlling an application of heat to the tank storing water to substantially maintain the first temperature of the water within a range of about ten degrees above and ten degrees below the set point temperature.

4. The method of claim 1 further comprising preventing water temperatures in the upper portion of the tank from substantially exceeding a temperature of about ten degrees above the set point temperature.

5. The method or claim 1 further comprising preventing water temperatures in the upper portion of the tank from substantially falling below a temperature of about ten degrees below the set point temperature.

6. The method of claim 1 further comprising improving first hour delivery capacity by providing a dip tube extending substantially a full vertical length of the tank to reduce mixing of colder water entering the lower portion of the tank with existing warmer water in the upper portion of the tank.

7. The method of claim 1 further comprising improving energy efficiency of the water heater by providing a dip tube extending substantially a full vertical length of the tank to reduce mixing of colder water entering the lower portion of the tank with existing warmer water in the upper portion of the tank.

8. A gas fired residential water heater comprising:

a tank adapted to hold water, the tank having an inlet and an outlet;

a dip tube extending from the inlet into the tank;

a gas valve adapted to be in fluid communication with a supply of gas;

a gas burner mounted substantially below the tank and fluidly connected to the gas valve;

a lower temperature sensor providing a lower temperature signal representing a temperature of the water in a lower portion of the tank;

an upper temperature sensor providing an upper temperature signal representing a temperature of water in an upper portion of the tank; and a control having inputs connected to the lower temperature sensor and the upper temperature sensor and an output connected to the gas valve, the control operating the gas valve and igniting the gas burner in response to one of the temperature of the water in the upper portion of the tank being below a set point temperature plus a fixed, upper temperature differential and the temperature of the water in the lower portion of the tank being less than a set point temperature minus a fixed, lower temperature differential to minimize stacking of water temperatures in the tank, and the temperature of the water in the lower portion of the tank being above the set point temperature minus a fixed, lower temperature differential and the temperature of the water in the upper portion of the tank being less than the set point temperature minus a fixed, upper temperature differential to maintain water in the upper and lower portions of the tank within a desired temperature range about the set point temperature.

9. The water heater of claim 8 further comprising a control program executable by the control for opening and closing the valve to maintain the temperature of the water in the lower portion of the tank substantially between the set point temperature and the set point temperature minus the fixed, lower temperature differential, and the temperature of the water in the upper portion of the tank substantially between the set point temperature plus the fixed, upper temperature differential and the set point temperature minus the fixed, upper temperature differential.

10. The water heater of claim 9 further comprising an ignition device mounted adjacent the gas burner and connected to the control, the ignition device being operable by the control to ignite gas emanating from the gas burner in response to the valve being operable by the control to convey gas to the gas burner.

11. The water heater of claim 9 further comprising an input device in electrical communication with the control and operable to allow a user to enter the desired set point temperature.

12. The water heater of claim 8 wherein the control is battery operated.

13. The water heater of claim 8 wherein the gas valve is a combination 3VDC solenoid and millivolt low energy valve.

14. The water heater of claim 8 wherein the control comprises a microprocessor.

15. The water heater of claim 8 wherein the control comprises a microcontroller.

* * * * *

UNITED STATES PATENT AND TRADEMARK OFFICE

CERTIFICATE OF CORRECTION

PATENT NO. : 6,880,493 B2
DATED : April 19, 2005
INVENTOR(S) : Todd W. Clifford

It is certified that error appears in the above-identified patent and that said Letters Patent is hereby corrected as shown below:

Column 2,
Line 14, “hot water resulting” should read -- hot water, resulting --.
Line 20, “Most gas waters” should read -- Most gas water --.

Column 3,
Line 24, “elements is” should read -- element is --.
Line 41, “provides gas” should read -- provides a gas --.
Line 57, “valve A first” should read -- valve. A first --.

Column 7,
Line 36, “the dip tube the dip tube” should read -- the dip tube --.
Line 48, “tubes increases” should read -- tube increases --.

Column 9,
Line 55, “temperature at the water” should read -- temperature of the water --.

Column 10,
Line 25, “The method or claim 1” should read -- The method of claim 1 --.

Signed and Sealed this

Twentieth Day of December, 2005

JON W. DUDAS
*Director of the United States Patent and Trademark Office*